US006525479B1

(12) United States Patent
Keggenhoff et al.

(10) Patent No.: US 6,525,479 B1
(45) Date of Patent: Feb. 25, 2003

(54) METHOD AND BALLAST FOR OPERATING A LAMP FITTED WITH A FLUORESCENT TUBE

(75) Inventors: Ralf Keggenhoff, Sundern (DE); Ferdinand Mertens, Arnsberg (DE)

(73) Assignee: Trilux-Lenze GmbH & Co. KG, Arnsberg (DE)

( * ) Notice: Subject to any disclaimer, the term of this patent is extended or adjusted under 35 U.S.C. 154(b) by 0 days.

(21) Appl. No.: 09/830,522

(22) PCT Filed: Oct. 27, 1999

(86) PCT No.: PCT/DE99/03422

§ 371 (c)(1),
(2), (4) Date: Jul. 31, 2001

(87) PCT Pub. No.: WO00/25554

PCT Pub. Date: May 4, 2000

(30) Foreign Application Priority Data

Oct. 27, 1998 (DE) ..... 198 50 441

(51) Int. Cl.[7] ..... H05B 39/10
(52) U.S. Cl. ..... 315/88; 315/74; 315/307
(58) Field of Search ..... 315/74, 88, 91, 315/119, 174, 176, 209 R, 291, 307; 313/236

(56) References Cited

U.S. PATENT DOCUMENTS

| | | | | |
|---|---|---|---|---|
| 4,791,338 A | * | 12/1988 | Dean et al. | 315/174 |
| 5,039,921 A | | 8/1991 | Kakitani | 315/307 |
| 5,600,211 A | | 2/1997 | Derwent | 315/307 |
| 5,646,484 A | * | 7/1997 | Sharma et al. | 315/88 |
| 5,691,605 A | * | 11/1997 | Xia et al. | 315/307 |
| 5,798,614 A | | 8/1998 | Bishop | 315/107 |

FOREIGN PATENT DOCUMENTS

| | | |
|---|---|---|
| DE | 4314993 A | 5/1993 |
| DE | 19530485 A | 5/1993 |
| DE | 43 14 993 A1 | 11/1994 |
| DE | 197 15 341 C1 | 10/1998 |
| DE | 19715341 | 9/2001 |
| EP | 0 759 686 A1 | 8/1986 |
| EP | 0 413 991 A1 | 7/1990 |
| EP | 0 702 508 A1 | 9/1995 |
| EP | 702508 A | 3/1996 |
| EP | 0 889 675 A1 | 7/1997 |
| JP | 06267687 | 9/1994 |

* cited by examiner

*Primary Examiner*—Don Wong
*Assistant Examiner*—Jimmy T. Vu
(74) *Attorney, Agent, or Firm*—Brooks & Kushman P.C.

(57) ABSTRACT

The invention relates to a method and ballast for operating a lamp (3) fitted with a fluorescent tube (2), whereby the operating data of certain recognizable lamp types ($T_1$, $T_2$, $T_{n-1}$, $T_n$), at least the lamp voltage ($U_L$), lamp current ($I_L$) and preheating currents ($I_{vorh1}$, $I_{vorh2}$, $I_{vorhn-1}$, $I_{vorhn}$) is stored in a register (R) for the heating of the electrodes. The preheating current ($I_{vorh1}$, $I_{vorh2}$, $I_{vorhn-1}$, $I_{vorhn}$) are allocated to given areas of the resistance of the electrode ($R_E$>X), (Y≦$R_E$≦X), (Z≦$R_E$≦Y), the resistance of the electrode is measured during a preheating phase and the preheating current ($I_{vorh1}$, $I_{vorh2}$, $I_{vorhn-1}$, $I_{vorhn}$) allocated to the measured resistance of the electrode ($R_E$) is adjusted, whereby the fluorescent tube (2) is operated or a given period with a dimming current ($I_D$) of a known intensity within a given starting phase (S) occuring after the preheating phase (V), the existing voltage ($U_L$) of the fluorescent tube is measured, the register (R) is searched for the lamp voltage ($U_{L1}$, $U_{L2}$, $U_{L3}$, $U_{L(n-1)}$, $U_{(Ln)}$) that comes closest to the measured lamp voltage ($U_L$) of the fluorescent tube (2) and the operating data required for the operation of the fluorescent lamp (2) and allocated to the measured lamp voltage (UL) by the register (R) is adjusted.

13 Claims, 5 Drawing Sheets

OPERATING DATA BD

R

Figure 2:
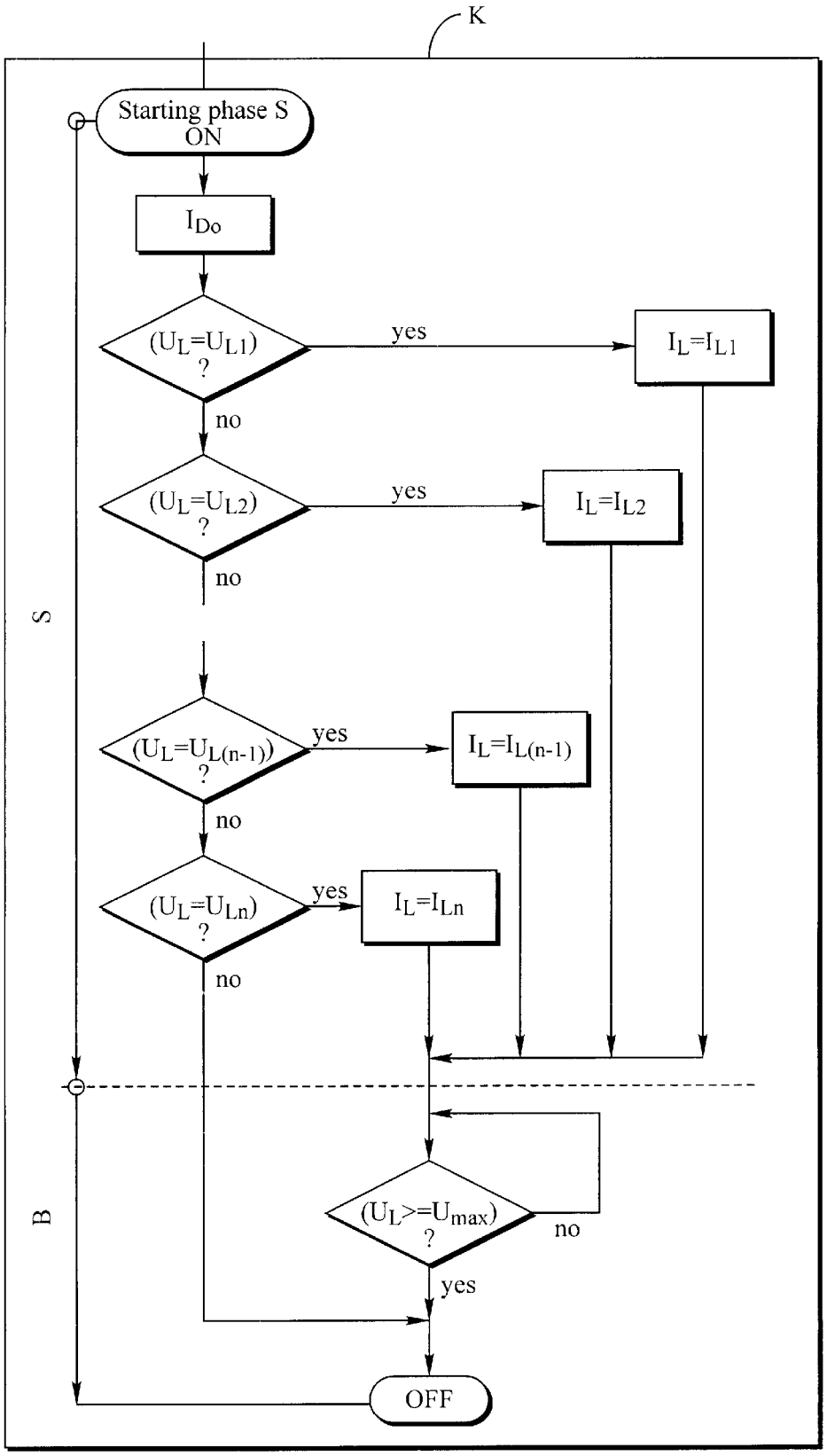

| LAMP GROUP / LAMP TYPE | LAMP CURRENT | RATED LAMP VOLTAGE | ELECTRODE RESISTANCE | ... | PRE-HEATING CURRENT | MAXIMUM LAMP VOLTAGE |
|---|---|---|---|---|---|---|
| $T_1$ | $G_1$ | $I_{L1}$ | $U_{L1}$ | $R_{L1}$ | ... | $I_{vorh1}$ | $U_{max}$ |
| $T_2$ | | $I_{L2}$ | $U_{L2}$ | $R_{L2}$ | ... | | |
| ... | $G_2$ | ... | ... | ... | ... | $I_{vorh2}$ | |
| $T_{n-1}$ | $G_{n-1}$ | $I_{L(n-1)}$ | $U_{L(n-1)}$ | $R_{L(n-1)}$ | ... | $I_{vorh(n-1)}$ | |
| $T_n$ | $G_n$ | $I_{Ln}$ | $U_{Ln}$ | $R_{Ln}$ | ... | $I_{vorhn}$ | |

*Fig. 1*

METHOD AND BALLAST FOR OPERATING A LAMP FITTED WITH A FLUORESCENT TUBE

The invention relates to a method and ballast for operating a lamp fitted with a fluorescent tube.

E 0 889 675 A1 discloses two ballasts with which several different types of fluorescent tubes can be operated under optimised operating conditions. However, the degree of optmisation of the operating conditions of a fluorescent tube that can be achieved with these ballasts leaves much to be desired.

One of the ballasts pursuant to EP 0 889 675 A1 provides for a preheating phase of the electrodes. It is a ballast for hot-start fluorescent tubes. With a ballast of this kind, the electrodes projecting into the interior of the tube at the ends of the discharge tube of the fluorescent tube are preheated. The electrodes, which are provided with an emitter material, emit ions in this process, causing the gas contained in the discharge tube to become electrically conductive. Only after this preheating phase is the so-called discharge path of the fluorescent tube ignited. This procedure spares the electrodes. The electrode resistance of the fluorescent tube that occurs is measured during the preheating phase, in order to draw an indirect conclusion as to the electrode temperature and perform gentle preheating.

Moreover, according to EP 0 889 675 A1, conclusions as to he type of fluorescent tube are said to be drawn with the aid of the electrode resistance measured. The fluorescent tube is initially supplied with a low current and the electrode temperature is measured indirectly. If the initial current is insufficient to heat the electrodes to an expected temperature, the current is increased in steps, until the electrode resistance or the expected electrode temperature is reached. However, as there are different types of lamps that have the same or very similar electrode resistance values at operating temperature, the electrode resistance is not a definitive criterion for distinguishing between lamp types. When using the known ballast, optimum operating conditions can only be set if the lamp types to be recognised have substantially different electrode resistances.

In another ballast known from EP 0 889 675 A1, the simple method of measuring the lamp voltage is applied in order to determine the type of fluorescent tube, rather than the more complex measurement of the electrode resistance. As the indirect measurement of the temperature via the electrode resistance is eliminated, this design falls back on the sample method of measuring the lamp voltage. Owing to the absence of optimised preheating, the electrodes of the fluorescent tube are subject to elevated wear when using this ballast. Furthermore, unequivocal distinction between different lamp types is again impossible if they have identical or very similar lamp voltages. Likewise, optimum operating conditions can only be set with this ballast if the lamp types to be recognised have markedly different lamp voltages.

The object of the invention is therefore to propose a simple method, and a ballast for implementing the method, by means of which a large number of commercially available types of fluorescent tubes can be operated with a higher degree of optimisation.

According to the invention, the object is solved by a method for operating a lamp fitted with a fluorescent tube, where the operating data of certain recognisable lamp types, i.e. at least the rated lamp voltage, the rated lamp current and the preheating currents and preheating times for preheating the electrodes are stored in a register, where the preheating currents are allocated to predefined electrode resistance ranges, the electrode resistance is measured during a preheating phase, the preheating current allocated to the measured electrode resistance and the allocated preheating time are set, the fluorescent tube is operated with a dimming current of known intensity for a predetermined time during a starting phase following on from the preheating phase, the prevailing lamp voltage of the fluorescent tube is measured after the starting phase, the register is then searched for the rated lamp voltage that comes closest to the measured lamp voltage of the fluorescent tube and the operating data required for operation of the fluorescent tube and allocated to the measured lamp voltage by the register are then set.

The recognition of the lamp type in the present invention is based on the principle of lamp voltage measurement during the starting phase of the fluorescent tube. However, the electrode resistance is also known, having been determined during the preceding preheating phase, thus providing another selection criterion for accurate determination of the lamp type. Thus, the method according to the invention not only provides electrode-sparing hot-starting of the fluorescent tube, but also permits accurate determination of the lamp type.

The term "operating data" is not taken only to mean the parameters required directly for operation of the fluorescent tube. It is also possible to store operating data, such as maximum lamp voltages and currents, electrode resistances and temperatures, that occur under abnormal operating conditions, for instance in order to bring about a safety shutdown, if appropriate.

To be able to understand the invention, it must be pointed out that the register can be used to store operating data, such as the rated lamp voltage and the rated lamp current, in direct form or, alternatively, in the form of other values that are linked to the operating data by way of correlation.

The invention also includes the option of altering and setting operating data of the fluorescent tube directly or of setting them indirectly via variables naturally linked to them. For example, the dimming current and the lamp current can be set by altering the frequency of the alternating current applied to the fluorescent tube in operation.

The term "short-term" operation is intended to mean a predefined operating period amounting to between a few seconds and several minutes.

The dimming current set at the beginning of the starting phase is equal to the lowest rated lamp current stored in the register, or is greater than this. If it corresponds to the lowest of the stored rated lamp currents, a fluorescent tube with a low rated lamp current cannot be overloaded, even after long-term operation under these conditions. However, as the starting phase lasts only a few seconds to minutes even fluorescent tubes whose rated lamp current is lower than the dimming current will not fail.

Favourably, an optimised dimming current is set during the start phase whose current intensity is sufficient for the operation of a fluorescent tube whose rated lamp current is greater than the optmised dimming current, and which does not destroy a fluorescent tube whose rated lamp current is lower than the optimised dimming current.

For lamp types with rated lamp currents higher than the optimised dimming current, the optimised dimming current supplies enough energy to generate sufficient luminous intensity. A dimmed setting lasting a few seconds to several minutes is acceptable, as sufficient brightness is already achieved.

For simplicity, the lowest preheating current stored in the register is set at the start of the first stage of the preheating phase, which is divided into several stages. After the first stage of the preheating phase, a first YES/NO query checks whether the electrode resistance falls within one of the predefined electrode resistance ranges. In the event of a YES decision, a further stage of the preheating phase as triggered, during which the preheating current of the previous stage is retained and the starting phase subsequently initiated. A NO decision triggers a further stage of the preheating phase where the next higher preheating current stored in the register is set at the beginning of this stage. After a predefined time, either the starting phase is initiated or a further YES/NO query is performed, followed by the same process steps as after the first YES/NO query.

For simplicity, the number of YES/NO queries is predetermined and can be defined for the required ballast either inherently or by means of a data processing program. Three steps are of importance for the course of the process: every YES decision triggers a further stage of the preheating phase, where the preheating current of the previous preheating stage is retained. Every NO decision triggers a further stage of the preheating phase with the next higher preheating current. If the decision in the last YES/NO query provided for in the course of the process is NO, this triggers an increase in the preheating current, which is followed, after a predefined period, by the starting phase, without a renewed YES/NO query being performed.

A further improvement in the method is achieved by dividing the stored operating data of the recognisable lamp types into lamp groups in the register, where each lamp group contains only fluorescent tubes with different rated lamp voltages, one of the electrode resistance ranges and a preheating current are allocated to each lamp group by the register, the lamp group to which the fluorescent tube belongs is determined via the measured electrode resistance or the last preheating current set during the preheating phase, the rated lamp voltage that comes closest to the measured lamp voltage of the fluorescent tube is searched within the established lamp group of the register during the subsequent starting phase, and the operating data are then set that are necessary for operation of the fluorescent tube and allocated to the measured lamp voltage by the register. Among the commercially available fluorescent tubes, there are ones that have the same rated lamp voltage, but different electrodes and electrode resistances. In the register according to the invention, however, these are allocated to different lamp groups, meaning that unequivocal allocation of the lamp type is possible within a lamp group on the basis of the rated lamp voltage measured.

In the further development of the method, an item of information obtained during the preheating phase, i.e. the electrode resistance determined or the last preheating current set during the preheating phase, is analysed for the starting phase and the further search for the exact lamp type is restricted to one lamp group by the register.

Moreover, the starting phase can also be improved by combining the recognisable lamp types into lamp groups. For this purpose, a dimming current is allocated to each lamp group in the register, where the dimming current to be set for the starting phase is already defined during the preheating phase by establishing the lamp group.

In an advantageous further development, the procedure of the method provides for a three-stage preheating phase with two possible YES/NO queries, where a NO decision in response to the second YES/NO query triggers the third stage of the preheating phase where, compared to the previous stage of the preheating phase, the highest preheating current stored in the register is set and the starting phase is initiated after a predefined time.

The three-stage procedure offers three predefined preheating currents which, starting with the lowest, can be increased in successive stages of the preheating phase.

The three-stage design of :he method for preheating is an advantageous compromise, as it permits sufficiently differentiated preheating of the large number of lamp types and the design effort for the ballast required remains within reasonable limits.

In order to avoid damage to the ballast required, particularly if the fluorescent tube is defective and an abnormal operating condition arises where the lamp voltage rises, a maximum lamp voltage can be stored in the register for each lamp type. During operation of the fluorescent tube, a check is then made of whether the lamp voltage currently present during operation exceeds the maximum lamp voltage. If the maximum lamp voltage is exceeded, a safety shutdown of the fluorescent tube is performed. The lamp voltage check can, for example, be performed continuously or at defined intervals.

Similarly, a minimum lamp voltage can also be stored in the register and checked to ascertain whether the lamp voltage present is below the minimum value. Again, the fluorescent tube is shut down if the value is below the minimum.

The stored maximum lamp voltage is expediently greater than the highest lamp voltages stored in the register. Alternatively, different maximum lamp voltages can be stored for every single lamp type or groups of lamps types.

The starting phase is performed by operating an ON/OFF switch allocated to the lamp or, expediently, also initiated by inserting a fluorescent tube in an empty lamp socket while the lamp is switched on. This prevents a fluorescent tube being operated with the wrong operating data after being put into operation while the lamp is switched on. The same applies to the preheating phase. This can also be initiated by operating an ON/OFF switch or by inserting a fluorescent tube in an empty lamp socket.

The invention furthermore consists in a particularly simple design of a ballast for implementation of the method according to the invention, with a frequency generator and a control circuit interacting with this, which supplies the fluorescent tube with an alternating voltage via power transistors, where the lamp current can be set by a limiter, a register in which the operating data of several lamp types are stored, a sequence control system for controlling the timing of the process steps to be executed during a starting phase of the fluorescent lamp, a measured-value analyser, a lamp voltage measuring device and a direct-voltage generator with which a logic voltage can be generated.

The lamp current can, for example, be set indirectly via the frequency of the alternative voltage, by varying the direct voltage or by impedances of variable value.

The structured design of a ballast of this kind is advantageous. Its design makes it possible to supply only the control circuit and the downstream power transistors with high energy through the direct-voltage generator in order to operate the fluorescent tube.

In order to be able to perform an optimum hot start of the fluorescent tube, the ballast is provided with an electrode resistance measuring device. In addition, the sequence control system can be used to control the timing of the process steps to be executed during a preheating phase of the fluorescent tube.

The sequence control system, the measured-value analyser, the register and the frequency generator are expediently located in a common control device, this also being referred to as the controller.

The direct-voltage generator has a connection which supplies energy to the parts of the ballast involved that are involved in data processing. The energy is tapped in the form of a stabilised logic voltage, which is substantially lower than the lamp voltage required for supplying the lamp.

The control device, the control circuit, the lamp voltage measuring device and the electrode resistance measuring device are supplied with a stabilised direct voltage via the direct-voltage generator. This is tapped as a so-called logic voltage at a separate connection of the direct-voltage generator and is substantially lower than the lamp voltage required for supplying the lamp.

Figure 3:
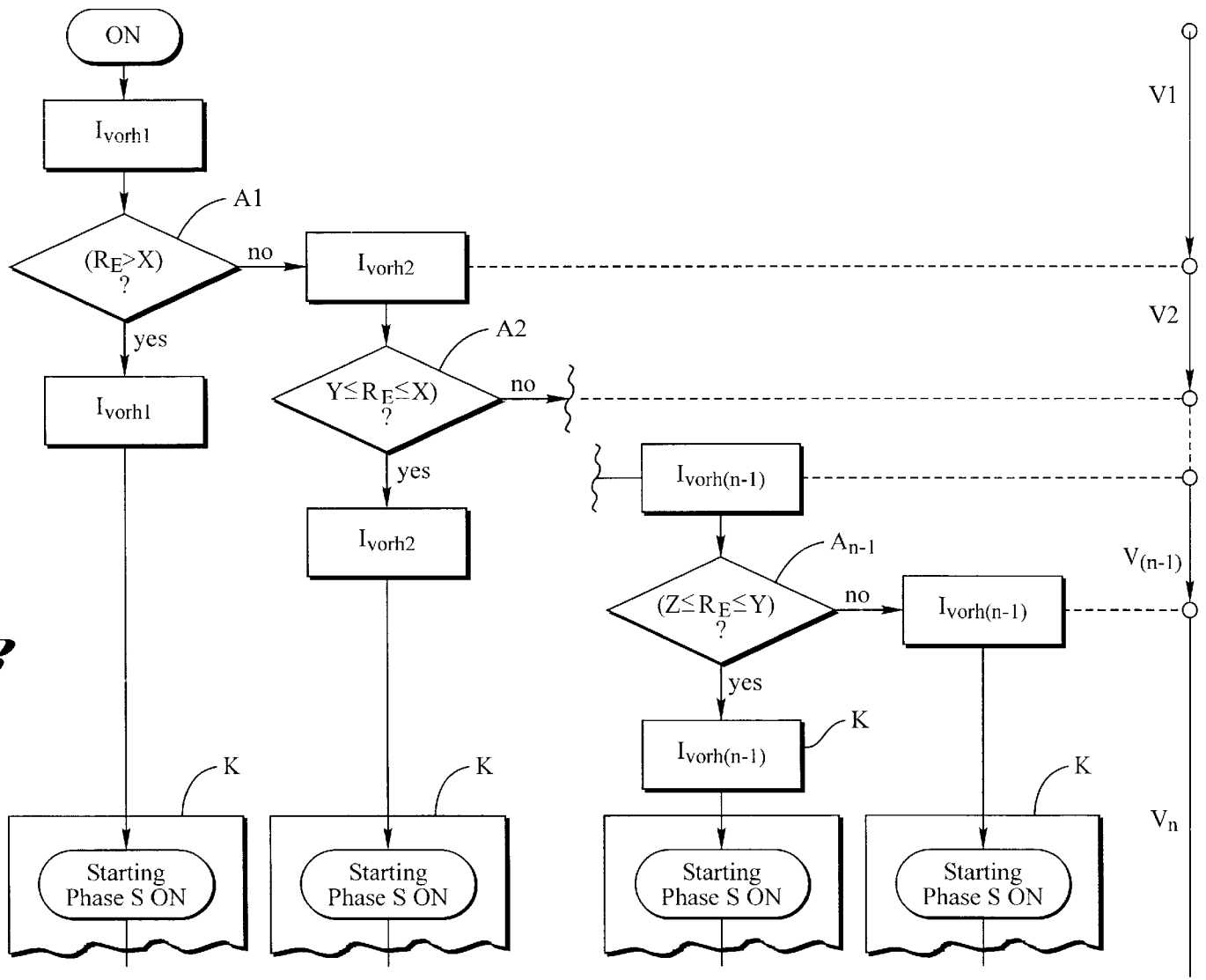
Figure 4:
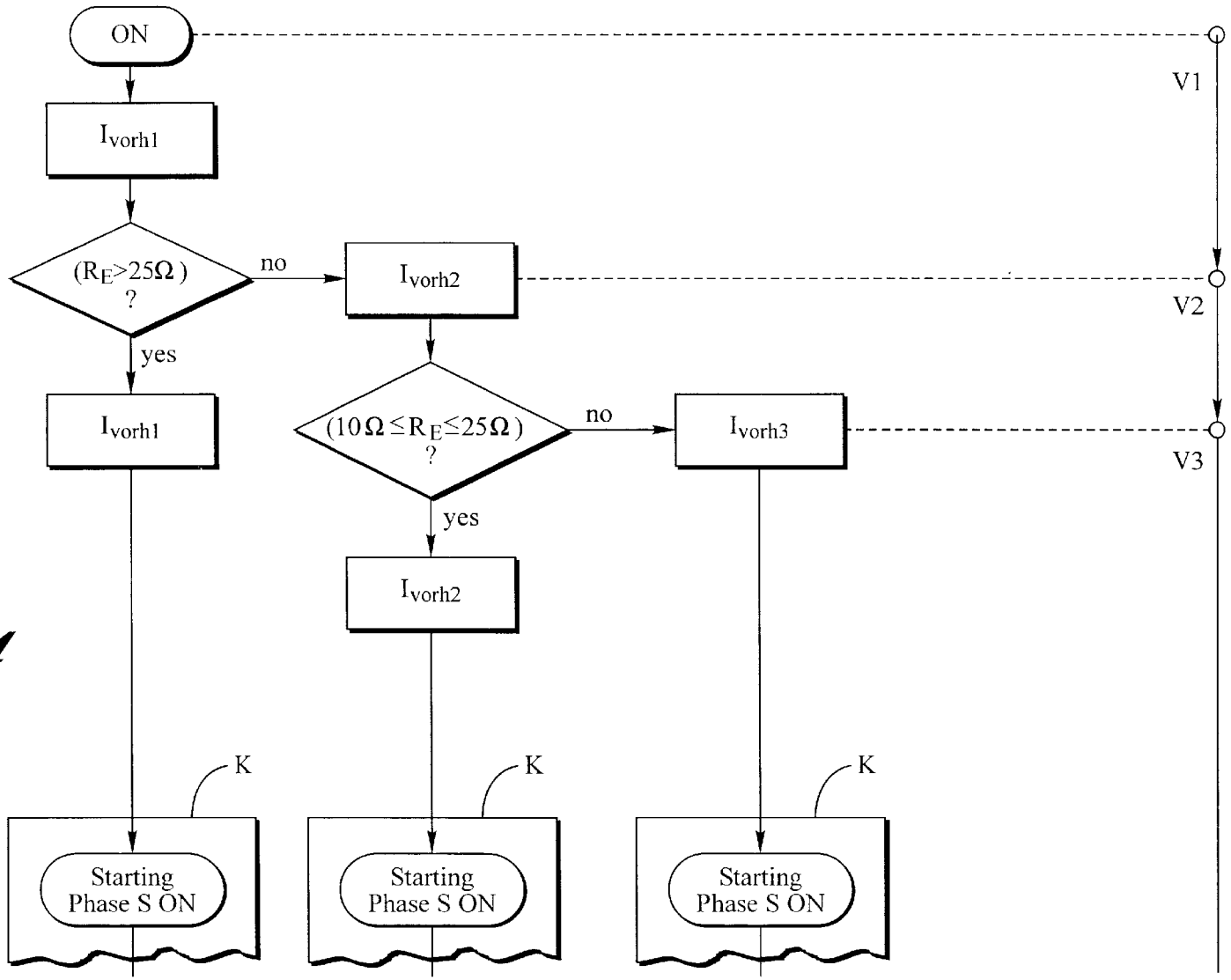
Figure 5:
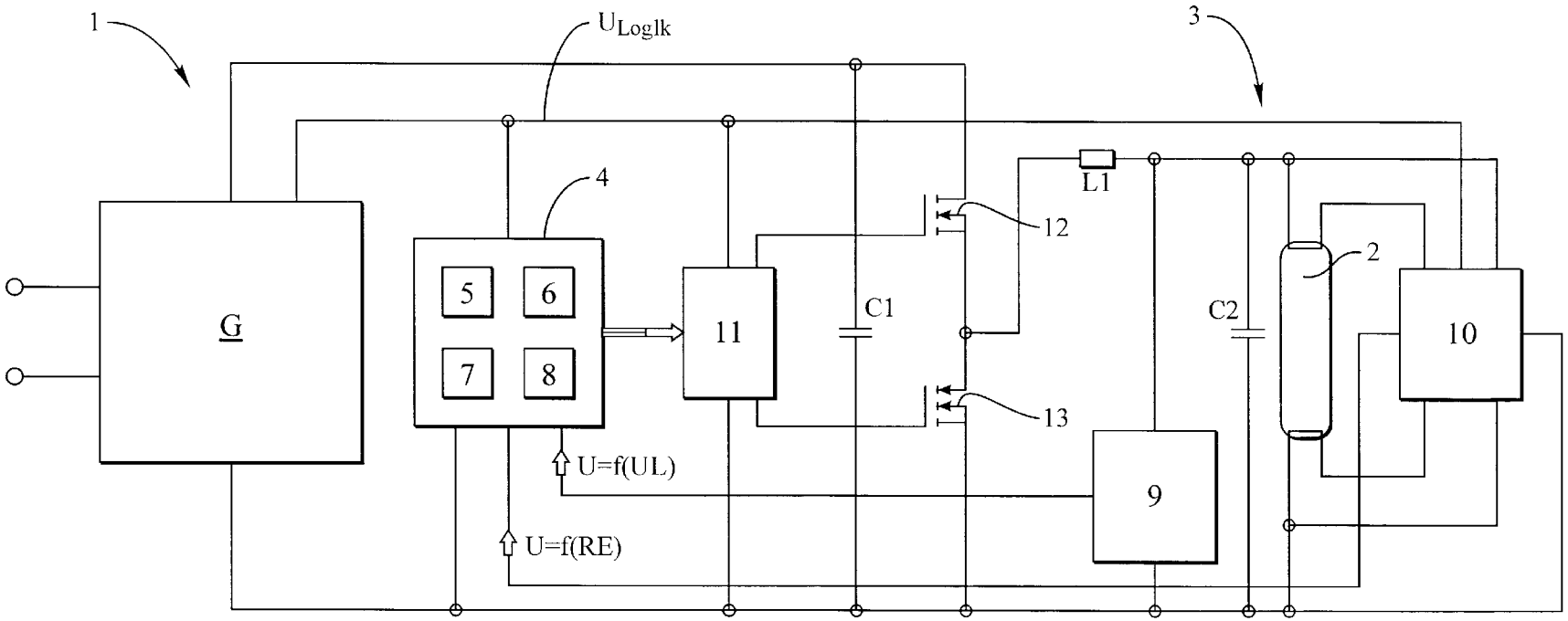

An example of the invention is illustrated in the drawing and explained in detail based on the figures. The figures show the following:

FIG. 1 A schematic diagram of the operating data of different types of fluorescent lamps stored in a register, FIG. 2 A flow chart, in which the determination of the lamp type during the starting phase of a fluorescent tube is illustrated, FIG. 3 A flow chart illustrating an n-stage preheating phase of a fluorescent tube, FIG. 4 A flow chart illustrating a three-phase preheating phase of a fluorescent tube, FIG. 5 A schematic wiring diagram of one configuration of a ballast.

Before the individual steps of the method are explained on the basis of FIGS. 2 to 5, reference will first be made to register R, schematically illustrated in FIG. 1, which is used to store the operating data of several lamp types, $T_1$, $T_2$, . . . $T_{n-1}$ and $T_n$, that can be operated under optimised conditions using the proposed method and the ballast.

According to FIG. 1, register R contains operating data for lamp types $T_1$, $T_2$, . . . , $T_{n-1}$ and $T_n$, which are divided into lamp groups $G_1$, $G_2$, . . . $G_{n-1}$ and $G_n$ in the present practical example. Also stored for each lamp type in register R are the lamp current $I_L$, the lamp voltage $U_L$, the electrode resistance $R_E$, a preheating current $I_{vorh}$ and a maximum lamp voltage $U_{max}$. These operating data are likewise stored in register R with the indices 1, 2, (n−1) and n, in keeping with the indices of the lamp types $T_1$, $T_2$, . .. $T_{n-1}$ and $T_n$.

The method according to the invention initially provides for a preheating phase V and a subsequent starting phase S. FIG. 2 first explains starting phase S, during which the lamp type is actually determined, i.e. by measuring the lamp voltage. Preheating phase V, which precedes starting phase S in the operating sequence, is described on the basis of FIG. 3.

According to FIG. 2, flow chart K of the method for operating a fluorescent tube begins with starting phase S. In FIG. 3, flow chart K, illustrated in simplified form, follows on from the four exemplary courses of the preheating phase.

According to the practical example in FIG. 2, a dimming setting is set at the beginning of starting phase S, during which a predefined, optimised dimming current $I_{Do}$ flows for a predetermined time.

For lamp type $T_2$, which has a medium rated lamp current $I_{L2}$, the predefined dimming current $I_{Do}$ already corresponds to the rated lamp current $I_{L2}$ stored in the register. Fluorescent tubes of lamp type $T_2$ are thus operated under optimum conditions from the beginning of starting phase S. Fluorescent tubes with a lower rated lamp current are slightly, but tolerably, overloaded. Fluorescent tubes with a higher rated lamp current can be operated safely with optimised dimming current $I_{Do}$, meaning that sufficient brightness is already achieved at this dimmed setting.

After the operating period at the dimmed setting, the actual lamp voltage $U_L$ of the fluorescent lamp in operation is measured. The lamp voltage measured is used to determine the lamp type not among all the lamps types $T_1$, $T_2$, . . . $T_{n-1}$ and $T_n$ stored in the register, but only within those lamp groups $G_1$, $G_2$, . . . $G_{n-1}$ and $G_n$ in register R that were already established by measuring the electrode resistance during preheating chase V. The possibility of confusion with other lamp types having the same rated lamp voltage is ruled out among the lamp types of any one lamp group.

If the measured lamp voltage $U_L$ matches one of the lamp voltages $U_{L1}$ to $U_{Ln}$ stored in lamp group $G_1$, $G_2$, . . . $G_{n-1}$ and $G_n$ of register R, it is precisely known which of lamp types $T_1$, $T_2$, . . . $T_{n-1}$ and $T_n$ is involved. The operating data of the determined lamp type $T_1$, $T_2$, . . . $T_{n-1}$ or $T_n$, as allocated by register R, are then set. In the present practical example, lamp current $I_L$ is set in this context. It is set, for example, via a corresponding change in the alternative-currency frequency with which the fluorescent tube is supplied. From then on, the fluorescent lamp is operated under optimised operating conditions during operating phase B.

In order to avoid damage, a check is made during operating phase B of the fluorescent tube to ascertain whether the currently prevailing lamp voltage $U_L$ exceeds the maximum lamp voltage $U_{max}$ stored in register R. If the maximum lamp voltage $U_{max}$ is exceeded, a safety shutdown of the fluorescent tube is then performed.

According to FIG. 2, operating phase B is terminated by a regular disconnection procedure.

FIGS. 3 and 4 illustrate the procedure for a fluorescent tube started with preheating. FIG. 3 shows a flow chart with n-stage preheating phase of a fluorescent tube. Stages $V_1$, $V_2$, . . . $V_{(n-1)}$ and $V_n$ of the preheating phase are illustrated.

At the beginning of a first stage $V_1$ of the preheating phase, the lowest preheating current $I_{vorh1}$ stored in register R is set. At the end of the first stage $V_1$ of the heating phase, a first YES/NO query $A_1$ checks whether the electrode resistance $R_E$ falls within the predetermined range ($R_E$>X). In the event of a YES decision, a further stage $V_2$ of the preheating phase is triggered, where preheating current $I_{vorh1}$ of previous stage $V_1$ is retained and starting phase S subsequently initiated. A NO decision triggers a further stage $V_2$ of the preheating phase, where the next higher preheating current $I_{vorh2}$ stored in register R is set at the beginning of this stage $V_2$ and, after a predetermined time, either starting phase S is initiated or a further YES/NO query $A_2$ is carried out to establish whether electrode resistance $R_E$ falls within the predetermined range (Y<=$R_E$<=X) . YES/NO query $A_2$ is followed by the same process steps as YES/NO query $A_1$. In the event of a YES decision, a further stage of the preheating phase is triggered, where preheating current $I_{vorh2}$ of preceding stage $V_2$ is retained and starting phase S subsequently initiated. A NO decision triggers a further stage of the preheating phase (not shown), where the next higher preheating current stored in register R is set at the beginning of this stage and, after a predetermined time, either starting phase S is initiated or a further YES/NO query (not shown) is carried out.

According to FIG. 3, a penultimate stage $V_{(n-1)}$ of the preheating phase is followed by a YES/NO query An, which checks whether electrode resistance $R_E$ falls within the predetermined range (Z<=$R_E$<=Y) . In the event of a YES decision, stage $V_n$ of the preheating phase is triggered, where preheating current $I_{vorh(n-1)}$ of preceding stage $V_{(n-1)}$ is retained and starting phase S subsequently initiated. A NO decision triggers the final stage $V_n$ of the preheating phase, where the highest preheating current $I_{vorhn}$ stored in register R is set at the beginning of this stage $V_n$ and, after a predetermined time, starting phase S is initiated immediately without carrying out a further YES/NO query.

Stages $V_1$, $V_2$, $V_{(n-1)}$ and $V_n$ of the preheating phase, illustrated in FIG. 3, are all followed by the same flow chart K as per FIG. 2. This is indicated in FIG. 3 by the multiple entry of reference letter K. Starting phase S always takes an identical course in this context.

In the configuration of the process flow pursuant to FIG. 4, provision is made for a three-stage preheating phase with two possible YES/NO queries $A_1$ and $A_2$. In this context, a NO decision in the second YES/NO query $A_2$ triggers the third stage $V_3$ of the preheating phase. Compared to previous stage $V_2$ of the preheating phase, the highest preheating current $I_{vorh3}$ stored in register R is set in this context and, after a predetermined time, starting phase S is initiated immediately without carrying out a further YES/NO query.

Finally, FIG. 5 represents a ballast 1 for operating a lamp 3 fitted with a fluorescent tube 2, which is suitable both for carrying out a hot start and for carrying out a cold start. Ballast 1 has a control device 4, also referred to as the controller. This is provided with a sequence control system 5, a measured-value analyser 6, a data memory referred to as register 7 and a frequency generator 8.

The operating data of several lamp types are stored in register 7 of controller 4. Sequence control system 5 controls the timing of the process steps to be executed during the starting phase of fluorescent tube 2. Moreover, the timing of the process steps to be executed during the preheating phase of fluorescent tube 2 can also be controlled by means of sequence control system 5.

Furthermore, ballast 1 is provided with lamp voltage measuring device 9 and electrode resistance measuring device 10.

The measured values of lamp voltage measuring device 9 and of electrode resistance measuring device 10 are fed to measured-value analyser 6. Measured-value analyser 6 uses these to perform the YES/NO queries required in accordance with the proposed method during the preheating phase. In addition, it also analyses the measured lamp voltage $U_L$ and the rated lamp voltages $U_{L1} \ldots U_{Ln}$ stored in the register, as well as determining the precise lamp type in accordance with the proposed method.

A direct-voltage generator G generates a stabilised logic voltage $U_{Logik}$, with which it supplies energy to the part of ballast 1 involved in data processing, i.e. control device 4, sequence control system 5, measured-value analyser 6, register 7, frequency generator 8, lamp voltage measuring device 9 and electrode resistance measuring device 10.

Likewise supplied with logic voltage $U_{Logik}$ is control circuit 11, which interacts with frequency generator 8 and supplies fluorescent tube 2 with an alternating voltage via power transistors 12.

According to the proposed design, only control circuit 11 and downstream power transistors 12 and 13 are supplied with high voltage via a separate output of direct-voltage generator G in order to operate the fluorescent tube.

| List of reference numbers | |
|---|---|
| R | Register |
| $T_1$ | Lamp type |
| $T_2$ | Lamp type |
| $T_{n-1}$ | Lamp type |
| $T_n$ | Lamp type |
| $G_1$ | Lamp group |
| $G_2$ | Lamp group |

-continued

| List of reference numbers | |
|---|---|
| $G_{n-1}$ | Lamp group |
| $G_n$ | Lamp group |
| $I_L$ | Rated lamp current |
| $U_L$ | Rated lamp voltage |
| $R_E$ | Electrode resistance |
| $I_{vorh}$ | Preheating current |
| $U_{max}$ | Maximum lamp voltage |
| K | Flow chart |
| S | Starting phase |
| $I_D$ | Dimming current |
| $I_{Do}$ | Optimised dimming current |
| $V_1$ | First stage of the preheating phase |
| $V_2$ | Second stage of the preheating phase |
| $V_3$ | Third stage of the preheating phase |
| $V_{n-1}$ | Penultimate stage of the preheating phase |
| $V_n$ | Final stage of the preheating phase |
| $A_1$ | First YES/NO query |
| $A_2$ | Second YES/NO query |
| $A_{n-1}$ | Last YES/NO query |
| $R_E > X$ | Predefined electrode resistance range |
| $Y <= R_E <= X$ | Predefined electrode resistance range |
| $Z <= R_E <= Y$ | Predefined electrode resistance range |
| 1 | Ballast |
| 2 | Fluorescent tube |
| 3 | Lamp |
| 4 | Control device (controller) |
| 5 | Sequence control system |
| 6 | Measured-value analyser |
| 7 | Register |
| 8 | Frequency generator |
| 9 | Lamp voltage measuring device |
| 10 | Electrode resistance measuring device |
| 11 | Control circuit |
| 12 | Power transistor |
| 13 | Power transistor |
| G | Direct-voltage generator |
| $U_{Logik}$ | Logic voltage |

What is claimed is:

1. The method for operating a lamp (3) fitted with a fluorescent tube (2), where the operating data of certain recognisable lamp types ($T_1$, $T_2$, $T_{n-1}$, $T_n$), i.e. at least the rated lamp voltage ($U_L$), the rated lamp current ($I_L$) and the preheating currents ($I_{vorh1}I_{vorh2}$, $I_{vorhn-1}$, $I_{vorhn}$) for preheating the electrodes, are stored in a register (R), where the preheating currents ($I_{vorh1}$, $I_{vorh2}$, $I_{vorhn-1}$, $I_{vorhn}$) are allocated to predefined electrode resistance ranges ($R_E$>X; Y<=$R_E$<=X; Z<=$R_E$<=Y), the electrode resistance ($R_E$) is measured during a preheating phase (V) and the preheating current ($I_{vorh1}$, $I_{vorh2}$, $I_{vorhn-1}$, $I_{vorhn}$) allocated to the measured electrode resistance ($R_E$) is set, characterised in that the fluorescent tube (2) is operated with a dimming current ($I_D$) of known current intensity for a predetermined time during a starting phase (S) following on from the preheating phase (V), the prevailing lamp voltage ($U_L$) of the fluorescent tube (2) is measured after the starting phase (S), the register (R) is then searched for the rated lamp voltage ($U_{L1}$, $U_{L2}$, $U_{L(n-1)}$, $U_{Ln}$) that comes closest to the measured lamp voltage ($U_L$) of the fluorescent tube (2) and the operating data required for operation of the fluorescent tube (2) and allocated to the measured lamp voltage ($U_L$) by the register (R) are then set.

2. The method as per claim 1, characterised in that a dimming current ($I_D$) is set at the beginning of the starting phase (S) that corresponds to the lowest rated lamp current ($I_{L1}$) stored in the register (R) or is greater than this.

3. The method as per claim 1, characterised in that an optimised dimming current ($I_{Do}$) is set during the starting phase (S) whose current intensity is sufficient for the operation of a fluorescent tube (2) whose rated lamp current ($I_{L1}$, $I_{L2}$, $I_{L(n-1)}$, $I_{Ln}$) is greater than the optimised dimming current ($I_{Do}$), and which does not destroy a fluorescent tube (2) whose rated lamp current ($I_{L1}$, $I_{L2}$, $I_{L(n-1)}$, $I_{Ln}$) is smaller than the optimised dimming current ($I_{Do}$).

4. The method as per claim 1, characterised in that the lowest preheating current ($I_{vorh1}$) stored in the register (R) is set at the start of the first stage ($V_1$) of the preheating phase (V), in that, after the first stage ($V_1$) of the preheating phase (V), a first YES/NO query ($A_1$) checks whether the electrode resistance ($R_E$) falls within one of the predefined electrode resistance ranges ($R_E$>X; Y<=$R_E$<=X; Z<=$R_E$<=Y), in that a YES decision triggers a further stage ($V_2$) of the preheating phase (V), during which the preheating current ($I_{vorh1}$) of the previous stage ($V_1$) is retained and the starting phase (S) subsequently initiated, and a NO decision triggers a further stage ($V_2$) of the preheating phase (V) where the next higher preheating current ($I_{vorh2}$) stored in the register (R) is set at the beginning of this stage ($V_2$) and, after a predefined time, either the starting phase (S) is initiated or a further YES/NO query ($A_2$) is performed, followed by the same process steps as after the first YES/NO query ($A_1$).

5. The method as per claim 1, characterised in that the stored operating data of the recognisable lamp types ($T_1$, $T_2$, $T_{n-1}$, $T_n$) are divided into lamp groups ($G_1$, $G_2$, $G_{n-1}$, $G_n$) in the register (R), where each lamp group ($G_1$, $G_2$, $G_{n-1}$, $G_n$) contains only fluorescent tubes (2) with different rated lamp voltages ($U_{L1}$, $U_{L2}$, $U_{L-1}$, $U_{Ln}$), in that one of the electrode resistance ranges ($R_E$>X; Y<=$R_E$<=X; Z<=$R_E$<=Y) and a preheating current ($I_{vorh1}$, $I_{vorh2}$, $I_{vorhn-1}$, $I_{vorhn}$) are allocated to each lamp group ($G_1$, $G_2$, $G_{n-1}$, $G_n$) by the register (R), in that the lamp group ($G_1$, $G_2$, $G_{n-1}$, $G_n$) to which the fluorescent tube (2) belongs is determined via the measured electrode resistance ($R_E$) or the last preheating current ($I_{vorh1}$, $I_{vorhn-1}$, $I_{vorhn}$) set during the preheating phase (V), in that the rated lamp voltage ($U_{L1}$, $U_{L2}$, $U_{L-1}$, $U_{Ln}$) that comes closest to the measured lamp voltage ($U_L$) of the fluorescent tube (2) is searched within a lamp group of the register (R) during the subsequent starting phase (S), and the operating data are then set that are necessary for operation of the fluorescent tube (2) and allocated to the measured lamp voltage ($U_L$) by the register (R).

6. The method as per claim 5, characterised in that a dimming current ($I_D$) is allocated to each lamp group in the register (R), where the dimming current ($I_D$) to be set for the starting phase (S) is already defined during the preheating phase (V) by establishing the lamp group ($G_1$, $G_2$, $G_{n-1}$, $G_n$).

7. The method as per claim 1, characterised in that the procedure of the method provides for a three-stage preheating phase (V) with two possible YES/NO queries ($A_1$, $A_2$), where a NO decision in response to the second YES/NO query ($A_2$) triggers a third stage ($V_3$) of the preheating phase (V) where, compared to the previous stage ($V_2$) of the preheating phase (V), the highest preheating current ($I_{vorh3}$) stored in the register (R) is set and the starting phase (S) is initiated after a predefined time.

8. The method as per claim 1, characterised in that a maximum lamp voltage ($U_{max}$) and/or a minimum lamp voltage is stored in the register (R) for each lamp type ($T_1$, $T_2$, $T_{n-1}$, $T_n$), in that, during operation of the fluorescent tube (2), a check is made of whether the lamp voltage ($U_L$) present during operation exceeds the maximum lamp voltage ($U_{max}$) or drops below the minimum lamp voltage, and in that, if the maximum lamp voltage ($U_{max}$) is exceeded or the minimum lamp voltage not reached, a safety shutdown of the fluorescent tube (2) is performed.

9. The method as per claim 1, characterised in that the preheating phase (V) is initiated by operating an ON/OFF switch allocated to the lamp (3) or by inserting a fluorescent tube (2) in an empty lamp socket while the lamp (3) is switched on.

10. A ballast for operating a lamp (3) fitted with a fluorescent tube (2), with a frequency generator (8) and a control circuit (11) interacting with this, which supplies the fluorescent tube (2) with an alternating voltage via power transistors (12, 13), where the lamp current ($I_L$) is being set by a limiter, a register (R) in which the operating data of several lamp types ($T_1$, $T_2$, $T_{n-1}$, $T_n$) are stored, a sequence control system (5) for controlling the timing of the process steps to be executed during a preheating phase (V) and a starting phase (S) of the fluorescent lamp (2), a measured-value analyser (6), a lamp voltage measuring device (9) and a direct-voltage generator (G) with which a logic voltage ($U_{Logik}$) can be generated.

11. The ballast as per claim 10, characterised in that an electrode resistance measuring device (9) is provided and in that the sequence control system (5) is being used to control the timing of the process steps to be executed during a preheating phase (V) of the fluorescent tube (2).

12. The ballast as per claim 10, characterised in that the sequence control system (5), the measured-value analyser (6), the register (R) and the frequency generator (8) are provided in a common control device (4).

13. The ballast as per claim 10, characterised in that the control device (4), the control circuit (11), the lamp voltage measuring device (9) and the electrode resistance measuring device (10) are supplied with a stabilised direct voltage via the direct-voltage generator (G).

* * * * *